US005692290A

United States Patent [19]

Mamada et al.

[11] Patent Number: 5,692,290

[45] Date of Patent: Dec. 2, 1997

[54] METHOD OF MANUFACTURING A CHIP INDUCTOR

[75] Inventors: Nobuo Mamada; Satoru Sekiguchi, both of Tokyo, Japan

[73] Assignee: Taiyo Yuden Kabushiki Kaisha, Tokyo, Japan

[21] Appl. No.: 528,698

[22] Filed: Sep. 15, 1995

[30] Foreign Application Priority Data

Sep. 19, 1994 [JP] Japan ..... 6-223528

[51] Int. Cl.[6] ..... H01F 41/06

[52] U.S. Cl. ..... 29/605; 29/608

[58] Field of Search ..... 29/605, 608; 264/272.19; 336/83, 233

[56] References Cited

U.S. PATENT DOCUMENTS 5,544,410 8/1996 Kato et al. ..... 29/605

FOREIGN PATENT DOCUMENTS 58-48410 3/1983 Japan .

6-5427 1/1994 Japan .

*Primary Examiner*—Carl E. Hall

*Attorney, Agent, or Firm*—Armstrong, Westerman, Hattori, McLeland & Naughton

[57] ABSTRACT

A winding core is formed by extruding a kneaded material to be obtained by kneading a powdered magnetic material and a binder. A plurality of bundled conducting wires are wound around the winding core into a coiled shape. An external cover element is formed by extruding the kneaded material to enclose the plurality of conducting wires. The winding core and the external cover element are sintered such that the plurality of bundled conducting wires wound around the core into a coiled shape are deformed into a zigzag manner by the stress due to shrinkage of the external cover element at the time of sintering thereof. The partially manufactured product, obtained by the preceding steps, is cut into a predetermined length to thereby obtain a plurality of chip inductor main bodies. An external electrode is formed on each of end surfaces of the respective chip inductor main bodies. The external electrode is connected to each end portion of the conducting wires. Each end portion of the conducting wires is exposed to each of the end surfaces of the respective chip inductor main bodies.

6 Claims, 2 Drawing Sheets

METHOD OF MANUFACTURING A CHIP INDUCTOR

BACKGROUND OF THE INVENTION

1. Field of the Invention

The present invention relates to a chip inductor which uses a sintered magnetic core and a method of manufacturing the same.

2. Description of Related Art

Conventionally, there is a known a method for manufacturing a chip inductor. In such conventional manufacturing method a kneaded material is obtained by kneading a powdered magnetic material; and a binder is pressurized to form it into a rectangular parallelepiped or a cylindrical body. Thereafter, it is sintered so as to manufacture a bar of the magnetic material. A conductor (or a conducting wire) is wound around the bar of the magnetic material to thereby mount a coil in a coiled manner. The coil is then covered with the kneaded material of the powdered magnetic material and the binder to thereby apply an external cover (or coating). Thereafter, the partially manufactured product thus obtained is sintered.

In the chip inductor manufactured by the above-described method, the coil is covered with the magnetic material. Therefore, a circular magnetic circuit is formed in a manner to enclose the coil so as to attain a high inductance value and little or no magnetic field leak outside the magnetic material. Consequently, an advantage is achieved in that, even if the chip inductor is disposed in close proximity to other parts, there will be no influence on the characteristics as an inductor, and a density of mounting parts on a wiring circuit board or the like can thus be made higher.

However, in the chip inductor manufactured by the above-described method, a pressure is applied to the bar of the magnetic material which is inside the coil via the conducting wire of the coil and/or via a clearance between adjoining winds of the conducting wire, due to shrinkage of the kneaded material which forms the external cover. Therefore, an adverse effect results in magnetic characteristics with consequent poor impedance characteristics. Further, the above-described method of manufacturing the chip inductor is not suitable for mass production.

SUMMARY OF THE INVENTION

The present invention has an object of providing a chip inductor which is superior in impedance characteristics and a method of manufacturing the same, which are free from the above-described disadvantages and which are suitable for mass production.

In order to attain the above and other objects, the present invention provides a chip inductor comprising: coiled conducting wire means; a magnetic core which is formed by sintering and in which the coiled conducting wire means is embedded; wherein said coiled conducting wire means comprises a plurality of bundled conducting wires which are coiled in a zigzag manner, both end portions of the coiled conducting wire means being exposed to both end surfaces of the magnetic core; and external electrodes which are coated on both the end surfaces of the magnetic core and which are connected to both the end portions of the coiled conducting wire means.

According to another aspect of the present invention, there is provided a method of manufacturing a chip inductor comprising the steps of: forming a winding core by extruding a kneaded material to be obtained by kneading a powdered magnetic material and a binder; winding a plurality of bundled conducting wires around the winding core into a coiled shape; forming an external cover element to enclose the plurality of conducting wires, the external cover element being formed by extruding said kneaded material; sintering the winding core and the external cover element such that the plurality of bundled conducting wires wound around the core into a coiled shape are deformed into a zigzag manner by a stress due to shrinkage of the external cover element at the time of sintering thereof; cutting a partially manufactured product obtained by the preceding steps into a predetermined length to thereby obtain a plurality of chip inductor main bodies; and forming an external electrode on each of end surfaces of the respective chip inductor main bodies, the external electrode being connected to each end portion of the conducting wires, said each end portion of the conducting wires being exposed to each of the end surfaces of the respective chip inductor main bodies.

Preferably, each of the plurality of bundled conducting wires is wound into a coiled shape in contact with a surface of the winding core.

The mixing ratio of the powdered raw material and the binder of the winding core is preferably selected to be equal to or smaller than the mixing ratio of the powdered raw material and the binder of the external cover element such that a shrinkage percentage, at the time of sintering, of the winding core becomes equal to, or larger than, the shrinkage percentage of the external cover element.

Further, the particle size of the powdered magnetic material of the winding core is selected to be equal to or smaller than the particle size of the powdered magnetic material of the external cover element such that a shrinkage percentage, at the time of sintering, of the winding core becomes equal to or larger than the shrinkage percentage of the external cover element.

In the chip inductor, according to one aspect of the present invention, the coiled conducting wire means comprises a plurality of bundled conducting wires which are coiled while running zigzag. As compared with the coiled conducting wire means of the same diameter, which is coiled without running zigzag, the length of the conducting wire means is longer and the impedance is larger.

According to the method of manufacturing the chip inductor according to another aspect of the present invention, a plurality of chip inductor main bodies as raw materials for final products can be manufactured at the same time by the following steps of: forming a winding core by extruding a kneaded material to be obtained by kneading a powdered magnetic material and a binder; winding a plurality of bundled conducting wires around the winding core into a coiled shape; forming an external cover element to enclose the plurality of conducting wires, the external cover element being formed by extruding the kneaded material; sintering the winding core and the external cover element; and cutting a partially manufactured product obtained by the preceding steps into a predetermined length. On each of end surfaces of the respective chip inductor main bodies, there are formed the external electrode which is connected to each end portion of the conducting wires. The above-described plurality of coiled conducting wires are deformed into a zigzag manner, at the time of sintering, by a stress due to the shrinkage of the external cover element. Therefore, due to this deformation of the coiled conducting wires, the clearance between the shrunk winding core and the wound conducting wires becomes smaller.

When the mixing ratio of the powdered raw material and the binder for the winding core is equal to the mixing ratio of the powdered raw material and the binder for the external cover element, or when the shrinkage percentage, at the time of sintering, of the winding core is made equal to the shrinkage percentage of the external cover element, there will be attained a most appropriate condition in which there is no clearance between the coiled conducting wires and the magnetic element inside the coiled conducting wires. As compared with a condition in which the conducting wires are not deformed, the impedance characteristics of the chip inductor can be improved.

If each of the plurality of bundled conducting wires is wound into a coiled shape in contact with the surface of the winding core, the kneaded material is sufficiently filled into the clearance between the adjoining winds of the conducting wires when the kneaded material is coated or covered on the winding core, on which the conducting wires have been wound, by the secondary extruder. Therefore, at the time of sintering, there will be no clearance between the magnetic element which serves as the winding core and the magnetic element which serves as the external cover element. As a result, the impedance characteristics of the inductor can further be improved.

BRIEF DESCRIPTION OF THE DRAWINGS

The above and other objects and the attendant advantages of the present invention will become readily apparent by reference to the following detailed description when considered in conjunction with the accompanied drawings wherein.

DETAILED DESCRIPTION OF PREFERRED EMBODIMENTS

An explanation will now be made about an embodying example of the present invention with reference to the accompanying drawings.

Figure 1A:
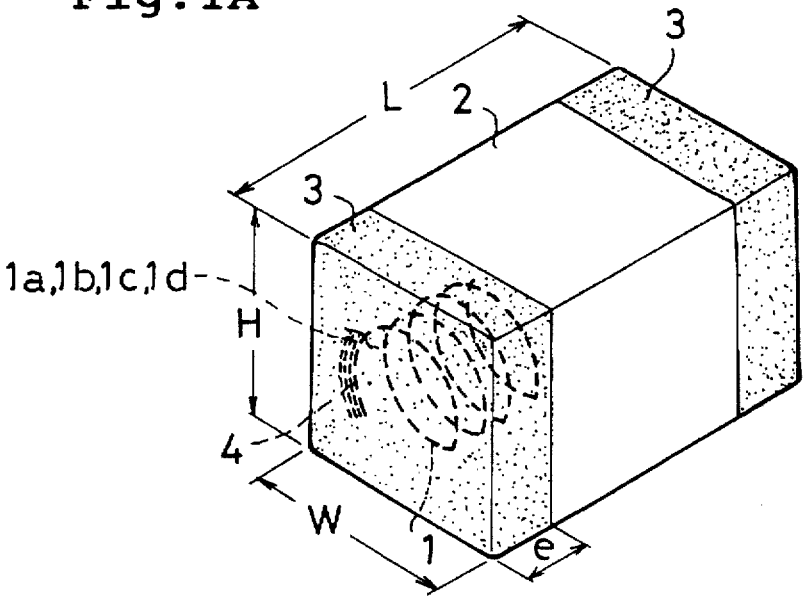
FIGS. 1A and 1B are a perspective view and a side view, partly shown in section, of one example of the chip inductor according to the present invention.
Figure 1B:
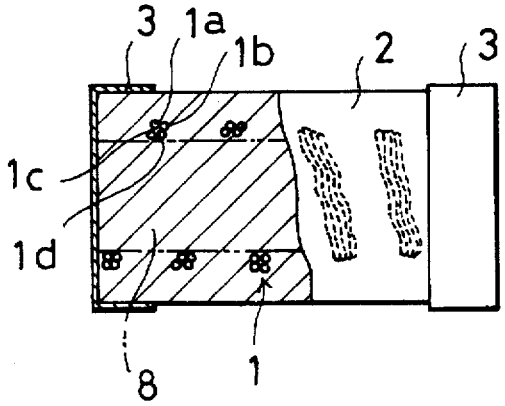

FIGS. 1A and 1B represent one example of a chip inductor according to the present invention.

In the Figure, reference numeral 1 denotes a coiled conducting member (or a coiled conducting wire) which was formed by winding in a zigzag manner, e.g., four conducting wires 1*a*, 1*b*, 1*c*, 1*d* made of silver wires of 20–100 μm in diameter. Reference numeral 2 denotes a magnetic member of a rectangular parallelepiped in which was embedded the coiled conducting member 1 and which was made of ferrite (e.g., L=1.0–10.0 mm, W=0.5–10.0 mm, H=0.5–10.0 mm). Reference numerals 3, 3 denote external electrodes which were made by coating both end surfaces and adjoining external peripheral end portions (e=0–4.0 mm) of the magnetic member 2. The external electrodes 3, 3 are connected to such arcuate or similar both end portions 4, 4 of the coiled conducting member 1 which were exposed to both the end surfaces of the magnetic member 2. These external electrodes 3, 3 were made, for example, of silver electrodes, and were subjected to nickel plating or lead-tin plating on the surface thereof.

The above-described magnetic member 2 was made up of an internal magnetic element which serves as a winding core around which the coiled conducting member 1 is wound, and a magnetic element which serves as an external cover element to cover the coiled conducting member 1. The internal magnetic element was made up of a ferrite whose composition is iron, nickel, zinc, copper or the like. This ferrite was manufactured by forming a kneaded material of columnar shape with a kneaded material of a powdered magnetic material (or raw meal of a magnetic material) of 0.7 μm in particle size and a binder of glycerine-methyl cellulose, both being mixed in the ratio of 100:8, and thereafter sintering the kneaded material. After sintering, it had a permeability of 100, and a shrinkage percentage at the time of sintering was 23%, for example. This shrinkage, at the time of sintering is also called a firing shrinkage; and the shrinkage percentage is represented by the formula $\{(l_0-l_1)/l_0\}\times 100$, where $l_0$ is the length of the formed partially manufactured product before sintering and $l_1$ is the length after sintering it. The magnetic element which serves as the external cover element was made by sintering a kneaded material made up of the powdered magnetic material of the same composition and particle size as those of the above-described internal magnetic element, and the same binder, also mixed in the same mixing ratio as that of the internal magnetic element. When this kneaded material was used, the rectangular parallelepiped (i.e., the external cover element) of 4.16 mm in height (H) and in width (W) became both 3.2 mm after sintering. The winding core, on the other hand, of 2.6 mm inside the coiled conducting wire 1 became 2.0 mm in external diameter after sintering. It is thus so formed that the clearance between the coiled conducting member 1 and the magnetic member as the magnetic core becomes zero.

The above-described coiled conducting wire 1 is wound, as described hereinabove, while running zigzag, the length thereof is longer than a coiled conducting wire of the same diameter without zigzag running, with a consequent larger impedance.

Next, an explanation will now be made about the method of manufacturing a chip inductor of the present invention as shown in FIG. 1.

Figure 2:
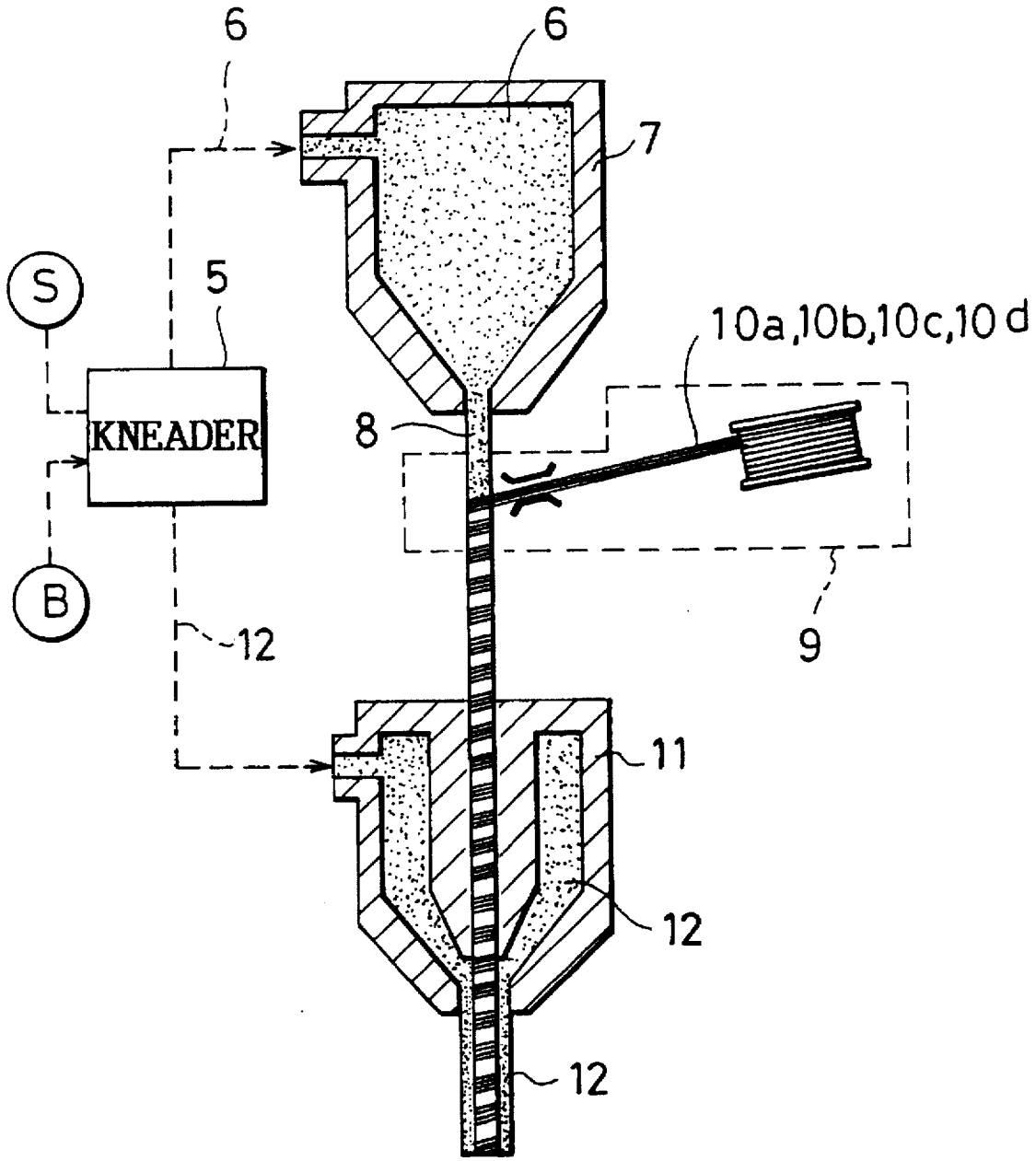
FIG. 2 is an explanation diagram showing an apparatus to be used in carrying out the method of manufacturing the chip inductor of the present invention.

As shown in FIG. 2, a binder S of the abovedescribed mixing ratio and a powdered magnetic material B were kneaded by a kneader 5 to homogenize the powdered magnetic material and the binder. The kneaded material 6 was fed under pressure to a primary extruder 7. A molded bar-like body 8, as a winding core, which was molded to a desired diameter of 0.5–10 mm, for example, was extruded out of an outlet of the primary extruder 7 at a speed of 30 m/min, for example. This bar-like body 8 was dried in a dryer (not shown). Thereafter, four conducting wires (generally called as the conducting member) 10*a*, 10*b*, 10*c*, 10*d*, for example, which were bundled together, were wound by a winding device 9 around the bar-like body 8. The bar-like body 8 having wound therearound the conducting wires 10*a*, 10*b*, 10*c*, 10*d* was fed to a secondary extruder 11. A kneaded material 12, which was made the same as the kneaded material 6 that was fed under pressure to the primary extruder 7, was fed in advance under pressure to the secondary extruder 11. Therefore, by this secondary extruder 11, the conducting wires 10*a*, 10*b*, 10*c*, 10*d* wound around the bar-like body 8 were coated or covered by the kneaded material 12, thereby forming an external cover element (or an external coating element). Thereafter, the partially manufactured product produced by the preceding steps was cut into a size to suit the size of a sintering furnace or the shape of the setting device on which the partially manufactured product is placed for sintering in the sintering furnace. The partially manufactured product was then sintered at 600°–1000° C., in particular at 900° C. As a result, the conducting wires 10*a*, 10*b*, 10*c*, 10*d* wound around the bar-like body 8 deformed into a zigzag manner by the stress due to the shrinkage of the external cover member. The partially manufactured product was then cut by a cutting device to suit the dimensions of respective inductors. The individual cut inductor main bodies 13 were then subjected to barrel polishing using a barreling powder and water and were rounded at corner portions. Thereafter, a silver paste was coated on both external surface portions of the magnetic member 2 of each inductor main body 13 and their adjoining peripheral external portions, as shown in FIG. 1, and was sintered to thereby form external electrodes 3. At this time, exposed end portions 4, 4, 4, 4 of a circular or a similar shape of the four conducting wires 10*a*, 10*b*, 10*c*, 10*d* and the external electrodes 3 were connected to each other. A nickel plating were applied to the silver layer of each external electrode 3 and a solder plating.

In this embodying example, the kneaded material for the external cover element was prepared by kneading the same binder an the powdered magnetic material having the same composition and the same particle size as those of the kneaded material for the winding core member. The mixing ratio of the powdered magnetic material and the binder was also made the same as that of the winding core so as to have the same shrinkage percentage as that of the winding core. It was thus so arranged that, at the time of sintering, the stress due to the shrinkage of the external cover element is not exerted on the internal magnetic element inside the coiled conducting member 1 via the coiled conducting member 1 and/or the clearance between the adjoining winds of the coiled conducting member 1. As a consequence, there is no deterioration in the impedance characteristics of the inductor. Further, since an arrangement was made that the plurality of conducting wires 1*a*, 1*b*, 1*c*, 1*d* were brought into contact with the internal magnetic element which was shrunk due to deformation and therefore that there is no clearance between the internal magnetic element and the conducting wires, the impedance characteristics are further improved.

Figure 3:
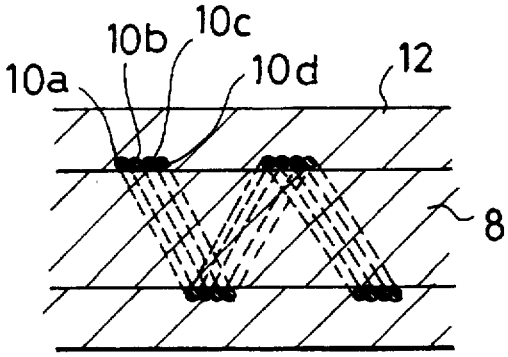
FIG. 3 is an explanation diagram showing another example of the condition of winding conducting wires around the winding core.

In this example, the four conducting wires are not always in contact with the bar-like body 8 which is the winding core, as can be seen in FIG. 1. However, the four conducting wires 10*a*, 10*b*, 10*c*, 10*d* can be wound as shown in FIG. 3 such that all of them are brought into contact with the bar-like body 8. Then, when the bar-like body 8 around which the four conducting wires 10*a*, 10*b*, 10*c*, 10*d* have been wound is coated with the kneaded material 12 by means of the secondary extruder 11, the space between the adjoining winds of the four conducting wires 10*a*, 10*b*, 10*c*, 10*d* can be easily filled or buried with the kneaded material. Therefore, after sintering, there will be a smaller possibility of giving rise to a clearance between the magnetic element which serves as the external cover element and the magnetic element which serves as the winding core, with the result that the impedance characteristics are further improved.

In this example, the mixing ratio of the powdered magnetic material and the binder for the winding core was selected to be the same as that of the powdered magnetic material and the binder for the external cover element and/or the particle size of the powdered magnetic material for the winding core was made the same as that of the powdered magnetic material for the external cover element. It was thus so arranged that the shrinkage percentage of the winding core at the time of sintering is the same as that of the external cover element. However, the following arrangement may also be employed. More particularly, the mixing ratio of the powdered magnetic raw material and the binder for the winding core is made to be 100:8, for example, and the mixing ratio of the external cover element is made to be larger than 100:8. The particle size of the winding core is made to be 0.7 μm, for example, and the particle size of the external cover member is made larger than 0.7 μm so that the shrinkage percentage, at the time of sintering, of the winding core is larger than that of the external cover element. Then, the coiled conducting member made up of a plurality of conducting wires is deformed by the stress due to the shrinkage of the external cover element and the clearance between the conducting member and the internal magnetic element becomes small, with the result that the impedance characteristics are improved.

Since the present invention has the above-described arrangement, it has the following advantages. Namely, a chip inductor having superior impedance characteristics can be obtained. Further, a method of manufacturing a chip inductor which is suitable for mass production and which is superior in impedance characteristics can be obtained.

It is readily apparent that the above-described chip inductor and the method of manufacturing the same meet all of the objects mentioned above and also has the advantage of wide commercial utility. It should be understood that the specific form of the invention hereinabove described is intended to be representative only, as certain modifications within the scope of these teachings will be apparent to those skilled in the art. Accordingly, reference should be made to the following claims in determining the full scope of the invention.

What is claimed is:

1. A method of manufacturing a chip inductor comprising the steps of:

forming a winding core by extruding a kneaded material, said kneaded material being obtained by kneading a powdered magnetic material and a binder;

winding a plurality of bundled conducting wires around said winding core into a coiled shape;

forming an external cover element to enclose said plurality of conducting wires, wherein said step of forming said external cover element comprises a step of extruding said kneaded material;

sintering said winding core and said external cover element such that said plurality of bundled conducting wires wound around said core into a coiled shape are deformed into a zigzag manner by a stress due to shrinkage of said external cover element at the time of sintering thereof;

cutting a product obtained by the preceding steps into a predetermined length to thereby obtain a plurality of chip inductor main bodies; and forming an external electrode on each of end surfaces of said respective chip inductor main bodies, said external electrode being connected to each end portion of said conducting wires, said each end portion of said conducting wires being exposed to each of said end surfaces of said respective chip inductor main bodies.

2. A method of manufacturing a chip inductor according to claim 1, wherein each of said plurality of bundled conducting wires is wound into a coiled shape in contact with a surface of said winding core.

3. A method of manufacturing a chip inductor according to claim 1, wherein a mixing ratio of the powdered raw material and the binder of said winding core is selected to be equal to or smaller than a mixing ratio of the powdered raw material and the binder of said external cover element such that a shrinkage percentage, at the time of sintering, of said winding core becomes equal to or larger than a shrinkage percentage of said external cover element.

4. A method of manufacturing a chip inductor according to claim 2, wherein a mixing ratio of the powdered raw material and the binder of said winding core is selected to be equal to or smaller than a mixing ratio of the powdered raw material and the binder of said external cover element such that a shrinkage percentage, at the time of sintering, of said winding core becomes equal to or larger than a shrinkage percentage of said external cover element.

5. A method of manufacturing a chip inductor according to claim 1, wherein a particle size of the powdered magnetic material of said winding core is selected to be equal to or smaller than a particle size of the powdered magnetic material of said external cover element such that a shrinkage percentage, at the time of sintering, of said winding core becomes equal to or larger than a shrinkage percentage of said external cover element.

6. A method of manufacturing a chip inductor according to claim 2, wherein a particle size of the powdered magnetic material of said winding core is selected to be equal to or smaller than a particle size of the powdered magnetic material of said external cover element such that a shrinkage percentage, at the time of sintering, of said winding core becomes equal to or larger than a shrinkage percentage of said external cover element.

* * * * *